US007802531B2

(12) United States Patent
Kluge et al.

(10) Patent No.: US 7,802,531 B2
(45) Date of Patent: Sep. 28, 2010

(54) RUDDER FOR SHIPS

(75) Inventors: Mathias Kluge, Hamburg (DE); Henning Kuhlmann, Hamburg (DE)

(73) Assignee: becker marine systems GmbH & Co. KG, Hamburg (DE)

( * ) Notice: Subject to any disclaimer, the term of this patent is extended or adjusted under 35 U.S.C. 154(b) by 3 days.

(21) Appl. No.: 12/070,346

(22) Filed: Feb. 14, 2008

(65) Prior Publication Data

US 2009/0126613 A1 May 21, 2009

(30) Foreign Application Priority Data

Nov. 13, 2007 (DE) ..... 20 2007 015 941 U
Dec. 12, 2007 (EP) ..... 07024061

(51) Int. Cl.
*B63H 25/06* (2006.01)

(52) U.S. Cl. ..... 114/162

(58) Field of Classification Search ..... 114/162, 114/165, 167, 169
See application file for complete search history.

(56) References Cited

U.S. PATENT DOCUMENTS 5,752,865 A * 5/1998 Ishii et al. ..... 440/67

FOREIGN PATENT DOCUMENTS

| | | | |
|---|---|---|---|
| DE | 11 40 484 | | 11/1962 |
| FR | 1 251 898 | | 1/1961 |
| GB | 332 082 | | 7/1930 |
| JP | 57191193 | A * | 11/1982 |
| JP | 06 305487 | | 11/1994 |
| JP | 09 011990 | | 1/1997 |
| WO | 2005/113332 | | 12/2005 |

* cited by examiner

*Primary Examiner*—Daniel V Venne
(74) *Attorney, Agent, or Firm*—Kelly Lowry & Kelley, LLP

(57) ABSTRACT

A rudder for ships having a rudder blade which has a leading edge and a trailing edge. The rudder blade has two superimposed rudder blade sections; the leading edge sections of which are offset such that a first leading edge section is offset port or starboard and a second leading edge section is offset starboard or port. The first leading edge section has a port-sided offset surface which projects over the second leading edge section, and the second leading edge section has a starboard-sided offset surface which projects over the first leading edge section. A flow body is configured so that its dimensions are adapted to the dimensions of the offset surfaces. The flow body covers the offset surfaces and is arranged in the area of both offset surfaces.

18 Claims, 8 Drawing Sheets

RUDDER FOR SHIPS

BACKGROUND OF THE INVENTION

1. Field of the Invention

This present invention relates to a rudder for ships with a rudder blade which has a leading edge and a trailing edge. The rudder blade has two superimposed rudder blade sections, the leading edge sections and/or the trailing edge sections of which are offset in such a manner that the one leading edge section and/or the one trailing edge section is offset port or starboard and the other leading edge section and/or trailing edge section starboard or port and that the one leading edge and/or trailing edge section has a port-sided offset surface which projects over the other leading edge section and/or the other trailing edge section and the other leading edge section and/or trailing edge section has a starboard-sided offset surface which protrudes over the one leading edge section and/or trailing edge section.

2. Description of the Related Art

Such rudders are known in the prior art and are often designated as twisted rudders. Generally, for such rudders, the rudder blade is divided into an upper and a lower half or an upper and a lower rudder blade section along a section plane which is oriented normally substantially horizontally for a mounted rudder. For a few embodiments, for example for twisted rudders with horn, the separating line between the two rudder blade sections can also be configured in a profile view non linearly, for example graded. Both rudder sections are placed adjacent to each other and can be fixedly connected with each other. Each rudder blade section has a leading edge section and a trailing edge section. The front leading edge areas (or sections) of both rudder sections are offset relative to each other or are placed twisted relative to each other, whereas both side wall surfaces of the respective rudder blade sections converge into a single continuous trailing edge section. The offset or the twisting of the rudder blade is provided for these embodiments only in the front area which is turned to the propeller. Moreover, multiple twisted rudders are known for which the leading edge is divided into three sections or more, wherein a section is placed respectively offset to its adjacent sections. Furthermore, there are also known embodiments for which the trailing edge sections of the single rudder blade sections turned to the propeller are placed offset to each other. On the other side, the opposed leading edge sections turned to the propeller merge for this embodiment into a continuous single strip. Furthermore, embodiments are also possible for which the rudder blade sections of the leading edge as well as of the trailing edge are offset to each other, wherein for this embodiment typically the nose and trailing edge of a rudder blade section are offset to different sides, i.e. the one strip to the port side and the other side to the starboard side.

When mounted in a ship, the rudder blade is assigned to a propeller placed on a drivable propeller axis and connected with the hull of the ship, wherein the rudder blade is placed behind the propeller in the direction of motion of the ship and the rudder blade is placed in such a manner that the (front) nose edge is turned to the propeller and that the (rear) strip is turned away from the propeller. Moreover, the rudder comprises normally additionally to the rudder blade a rudder port for the rudder post and a rudder post.

The indication that the rudder blade sections are placed superimposed refers to the mounted state of the rudder blade in which usually a section is placed above the other. Generally speaking, both rudder blade sections are thus placed adjacent to each other. Due to the offset arrangement of the leading edges to each other, an offset surface which protrudes or projects normally laterally respectively beyond the other leading edge is created on each leading edge in the area in which both leading edges are adjacent to each other. Thus, there is a (90°) edge in the transition area between the two leading edges on each side which runs into one of the offset surfaces. A further (90°) edge is created on the inner side of the offset surfaces.

FIGS. 7 and 8 show examples of twisted rudders known from the prior art with leading edges (sections) offset to each other. The rudder blade 100 has respectively two superimposed rudder blade sections 10, 30, wherein the leading edge sections 11, 21 are offset in such a manner that the one leading edge (or leading edge section) 11 is offset to the port side BB and the other leading edge (or leading edge section) 21 to the starboard side SB. Both side wall surfaces 100*a*, 100*b* of the rudder blade 100 or of both rudder blade sections 10, 20 merge into a single continuous trailing edge 30. Since both leading edges 11, 21 are to be placed offset to each other for the twisted rudder, one leading edge has always to be respectively offset to the port side and the other to the starboard side. Due to the offset arrangement, there results respectively an offset surface 18 in the area of the transition between the leading edges 11, 21 on each rudder blade side. The offset surface 18 represented in FIG. 8 is formed by the part of the lower side of the upper leading edge 11 which projects over the lower leading edge 21. The offset surface existing on the opposite side (which is not depicted here) is formed correspondingly by the part of the upper side of the lower leading edge 21 which projects over the upper leading edge 11.

FIG. 9 shows a further example of a twisted rudder known from the prior art for which both rudder blade sections 10, 20 of the rudder blade 100 are offset to each other in the area of their trailing edge sections 30*a*, 30*b*. On the other hand, the leading edge 11 turned to the propeller in mounted state is configured continuous. Due to the offset arrangement, there results for this embodiment an offset surface 18 on each rudder side, wherein the offset surfaces 18 are configured between the transitions of the trailing edges (trailing edge sections 30*a*, 30*b*). The offset surface 18 depicted in FIG. 9 is formed by the part of the upper side of the lower trailing edge 30*b* which projects laterally over the upper trailing edge 30*a*.

The advantage of such twisted rudders with two mirror-inverted cross section profiles consists on the one hand in avoiding the vapour bubble formation and on the other hand in avoiding erosion phenomena on the rudder which appear due to cavitation formation for high-speed ships with high loaded propellers. Moreover, the special configuration of the rudder blade contributes to a reduction of the fuel consumption. Besides a considerable protection against cavitation, there is thus also an improvement of the degree of efficiency. Furthermore, a considerable saving of weight is achieved. In particular, these improvements can be produced in that, due to the offset arrangement of the leading edges of both rudder blade sections, an adaptation to the twist in the propeller jet takes place.

For such rudders, because of the offset arrangement of the front leading edges or of the rear trailing edges and the thus caused angular transitions between the strips of the single rudder blade sections, it can come to a swirl of the current so that a.o. the risk of cavitation is increased. Moreover, in spite of the orientation of the single front leading edges or the rear trailing edges with respect to the twist of the propeller jet, in particular in the transition area between the strips, it can come to a separation of flow.

Furthermore, it is known in the prior the art to provide Costa bulbs on rudders. Costa bulbs are relatively big bulb or Zeppelin shaped bodies which are provided on rudder blades.

Costa bulbs are fundamentally known and are sometimes also designated as propulsion bulbs. They are provided in prolongation of the propeller (shaft) axis in the area of the rudder blade and clearly protrude from the rudder blade in direction of the propeller and beyond the rudder blade.

In particular, Costa bulbs project so far from the rudder blade that they (nearly) come to rest on the hub of the propeller. The distance between the Costa bulb and the propeller or the propeller hub should generally be the lowest possible so that as much of the water flow as possible produced by the propeller flows on the outside along the Costa bulb and not between the Costa bulb and the propeller hub.

Due to this prolongation of the whole profile of the hub, it is achieved that only a light swirl of the water flowing off develops. This being, it is however disadvantageous that the Costa bulb exerts a strong influence onto the propulsion behavior of the ship. If it is provided on an existing rudder, the propulsion behavior is influenced negatively and must be specially adapted to the propulsion behavior of the ship which causes complicated and expensive tests and trials. If such an adaptation does not take place, due to the provision of the Costa bulb, the fuel consumption of the ship is considerably increased.

SUMMARY OF THE INVENTION

The object of the invention is to provide a rudder for ships of the above-described type, for which erosion phenomena on the rudder due to cavitation formation, in particular for the use of speed ships with high loaded propellers are avoided and with which the fuel consumption is reduced or is held low.

According to the present invention, in a rudder of the above-described type, a flow body or a molded body is provided in the area of each offset surface or of the transition area between the two front leading edges and/or trailing edges. Moreover, the flow body is configured on the one hand in such a manner that it is limited with respect to its dimensions or to its physical extent to the area of the offset surfaces or of the transition area between the two leading edges and/or trailing edges. In other words, the flow body is dimensioned such that it does exist only locally in the area of the offset surfaces and does not or only to a small extent penetrate in other areas of the rudder or projects over the rudder. Thus, the flow body is adapted with respect to its size or shape to the offset surface or to the transition area of the two leading edges and/or trailing edges. In other words, it is configured exactly fitting. In particular, the flow body does not project, such as for example a Costa bulb, to a big extent over the rudder blade. Thus, the rudder according to the invention is formed or produced by excluding a Costa bulb or propulsion bulb. It is thus not a propulsion rudder (rudder with Costa bulb). Thus, in particular the flow body or molded body must not be on the propeller spindle axis as it is obligatorily necessary for the Costa bulb. In the contrary, the flow body or molded body can be placed offset with respect to the propeller shaft axis, in particular offset upwards or downwards (the rudder being mounted) without any problem.

The flow body, contrary to the Costa bulb, can also be placed spaced to the propeller hub since it does not, or not substantially, project over the leading edge.

Furthermore, the flow body is configured in such a manner that it substantially covers the offset surfaces or the transition area between the two front leading edges and/or trailing edges. The flow body is thus disposed in the area of the offset surfaces on the rudder blade and covers these surfaces so that the water flows along the flow body instead of on the offset surfaces. The risk of a flow swirl is thus reduced. The flow body or molded body or the walls of the molded body thus form a lateral bridging over or covering of the transition area between the upper and the lower rudder blade section. The term "covering" is to be understood here in such a way that the flow body covers the offset surfaces at least to a substantial extent.

It is advantageous for such a rudder that, due to a flow body which is configured only locally in the area of the offset surfaces and which covers the offset surfaces, the risk of a flow breakaway can be reduced, wherein the flow body simultaneously does not influence the propulsion behavior of the ship, this being due to the relatively small dimensions thereof. Thus, a "propulsion neutral effect" takes place. Moreover, the flow bodies can be placed without any problem on already existing rudders without complicated tests having to be carried out and without high costs. Thus, this invention is convenient for new constructions as well as for existing rudders for the later equipment thereof. Moreover, the probability of an occurring of swirls or turbulences is reduced in the transition area.

Basically, the flow body can be produced from any material known in the prior art that is suitable for this purpose. Appropriately, the flow body is made of wrought iron.

The present invention can also be used for multiple twisted rudders, wherein then at least one flow body is respectively to be provided in each transition area between the single sections of the front leading edge and/or the rear trailing edge.

Preferably, the shape of the flow body is configured in such a manner that the flow body closes the rudder profile fluidically in the area of the offset surfaces. In other words, the flow body forms a transition which guides the flow from one leading edge or trailing edge to the other. Thus, the flow body offers a flow guiding surface for a flowing of the flow without breakaway from the one leading edge or trailing edge to the other.

The flow body set on the rudder in the area of the offset surfaces forms a transition for the flow between the two front leading edges or trailing edges which are offset with respect to each other. In particular, it is preferred that the transition is configured edgeless or continuous. In this context, under the term "edgeless" it is understood that the transition does not have any projecting strong marked edges as it is the case for a normal twisted rudder without flow body in the area of the offset surfaces. On the border of the offset surfaces of normal twisted rudders, there are respectively (90°) edges. A substantially edgeless transition can be achieved for example by a rounded-off configured flow body or by a rounded-off transition between the rudder blade sections. The flow body could also be configured as a substantially oblique guiding surface which runs from the outer edge of an offset surface to the other leading edge or to the rear trailing edge so that the edge areas between the rudder blade and the flow body are less strongly marked. The probability of the occurrence of swirls is thus further reduced.

According to a further preferred embodiment of the invention, the flow body ends substantially at flush level with at least one of the front leading edges or rear trailing edges. The closed configuration of the rudder profile is thus further improved and it is ensured that the flow body does not influence negatively the propulsion system or the propulsion behavior of the ship. "Substantially at flush level" means in this context for example that the flow body encompasses the front strip or the trailing edge on its side turned to the propeller, however, it only slightly projects over the edges or not at all.

It is also preferred that the flow body projects over the leading edge or the trailing edge by maximally 10%, preferably by maximally 7%, particularly preferably by maximally 5% of the mean profile length of the rudder blade. It is thus achieved that the flow body has only a slight projection with respect to the rudder blade and thus does not influence negatively the propulsion behavior like a Costa bulb. Costa bulbs project with a much longer length with respect to the rudder blade, generally with a length of 20% and more of the mean profile length of the rudder blade.

Similarly, it is also preferred that the (maximal) length of the flow body substantially corresponds to the length of the offset surface and/or that the maximal width of the flow body substantially corresponds to the biggest profile thickness of the rudder, in particular the biggest profile thickness of the rudder in the transition area between the two rudder sections. The length of the flow body is thus approximately of the same length as the offset surfaces and the width of the flow body is smaller than or the same as the biggest profile thickness of the rudder. It is thus achieved that the flow body does not project or just only slightly projects over the proper rudder profile as it is the case, for example, for a Costa bulb and the propulsion behavior is not negatively influenced. Preferably, the length of the flow body is ⅕ to ½, particularly preferably ¼ to ⅓ of the length of the rudder blade. Furthermore, the height of a flow body is preferably 1/10 to ¼, particularly preferably ⅛ to ⅙ of the height of the rudder blade.

For creating an optimal flow transition between the two offset edges, it is preferred to configure rounded-off flow bodies. For this purpose, the flow body can have, for example, a spherical or a hemispherical shape or only a slightly rounded-off shape. Basically, only one single flow body can be provided as well which forms a flow guiding surface for both offset surface areas and/or which covers both offset surface areas. Thus, for this embodiment, the flow body is configured in such a manner that it is placed in both offset surface areas or in both side areas of the transition area between the two leading edges or trailing edges. This being, the flow body can be provided in one piece as well as in several pieces. It is particularly preferred that the flow body for this embodiment is configured spherically, drop-shaped, lentiform, cylindrical or torpedo-shaped. Basically, a combination of different basic shapes, for example a cylindrical basic body with a hemispherical end area, is possible. Advantageously, a flow body with such a shape is made of at least two single parts which are placed respectively on a rudder blade side in the area of an offset surface area and which form together a closed flow body. The overall shape of the body, for example cylindrical, drop-shaped, etc., results from the two single parts together with the intercalated rudder blade area. Such flow profiles are particularly optimal fluidically.

In another alternative embodiment, two flow bodies are provided, wherein each one is placed in respectively one offset surface area. Preferably, such flow bodies are arranged with an inclined plane or surface with respect to the rudder blade side wall, wherein they run obliquely from the outer edge of the offset surface of a leading edge or a trailing edge to the other leading edge or trailing edge. The flow body can eventually be configured rounded-off in the transition areas to the rudder blade. Such flow bodies or molded bodies can be configured in particular as a rounded-off side sheet metal.

In a further preferred embodiment of the invention, the size of the cross-sectional surface of the rudder blade diminishes from the upper area of the rudder blade to the lower area of the rudder blade.

Furthermore, an advantageous embodiment of the invention provides that the upper rudder blade section has a cross-sectional profile which is formed by a front surface which extends from the front leading edge to the rear trailing edge and which widens conically to a biggest profile thickness as well as by a rear surface which follows the front surface and tapers conically to the rear trailing edge, wherein both front surface sections which are formed by a middle line extending in longitudinal direction of the rudder blade have different sizes, the bigger surface section of which is situated on the port side and the smaller surface section is situated on the starboard side, wherein both surface sections formed by the middle line in the rear area of the cross-sectional profile are configured alike and that the lower rudder blade section of the rudder blade has a cross-sectional profile which is formed by a front surface extending from the front leading edge to the rear trailing edge and widening conically to a biggest profile thickness as well as by a rear surface following the front surface and extending to the rear surface, wherein both front surface sections formed by a middle line extending in longitudinal direction of the rudder blade have different sizes, the bigger surface section of which is situated on the starboard side and the smaller surface section is situated on the port side, wherein both surface sections formed by the middle line in the rear area of the cross-sectional profile are configured alike so that the leading edge of the upper rudder blade section which is assigned to the propeller is situated on the port side of the middle line and the leading edge of the lower rudder blade section is situated on the starboard side of the middle line.

Moreover, it is preferred that both cross-sectional surface sections turned to the propeller of the cross-sectional profile of the upper rudder blade section have edge areas with a flat curved course and with a strongly vaulted curved course and both cross-sectional surface sections turned away from the propeller of the cross-sectional profile of the upper rudder blade section have tangentially extending edge areas, wherein the cross-sectional surface section is situated with its edge area with a strongly vaulted curved course on the port side and both propeller-sided cross-section surface sections of the cross-sectional profile of the lower rudder blade section have edge areas with a flat curved course and with a strongly vaulted curved course, wherein both cross-sectional surface sections turned off the propeller of the cross-sectional profile of the lower rudder blade section have tangentially extending edge areas, wherein the cross-sectional surface section with its edge area with a strongly vaulted curved course is situated on the port side so that on the port side and on the starboard side the edge areas on both sides of the upper rudder blade section and of the lower rudder blade section have, in the area of the biggest profile thicknesses, a convexly outwards vaulted curved course with different arc radii so that conically tapering edge areas of the cross-sectional profiles are configured in direction of the leading edges.

Moreover, it is appropriate that the leading edges turned to the propeller have a rounded-off profile. It is further preferred that the flow body is configured rounded-off too at least in the area of the front rudder side turned to the propeller.

According to a further preferred embodiment, the rudder is configured in such a manner that a rudder trunk is provided as a cantilever with a central inner longitudinal bore for receiving the rudder post for the rudder blade and is configured penetrating into the rudder blade which is connected with the rudder end, wherein a bearing is placed in the inner longitudinal bore of the rudder for supporting the rudder post, this bearing penetrating with its free end into a recess, taper or the like in the rudder blade, wherein the rudder post is guided in its end area with a section out of the rudder trunk and is connected with the end of this section with the rudder blade, wherein no bearing is provided between the rudder blade and the rudder trunk and wherein the connection of the rudder post with the rudder blade is situated above the propeller shaft middle, wherein the inner bearing for supporting the rudder post in the rudder trunk is placed in the end area of the rudder trunk.

The advantage which results for such a rudder configured according to the invention for which the rudder post is positioned in the end area of the rudder trunk by means of one bearing, wherein the connection of the rudder post with the rudder blade is situated above the propeller shaft middle, without a further bearing being here necessary for the rudder blade on the outer wall surface of the rudder trunk, consists in that, for replacing the propeller shaft, the rudder post does not need any longer to be pulled out of the rudder trunk after having removed the rudder blade since the connection of the rudder post with the rudder blade is situated above the propeller shaft middle. Add to this that the rudder blade of the rudder can have a very slim profile.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE INVENTION

Figure 1C:
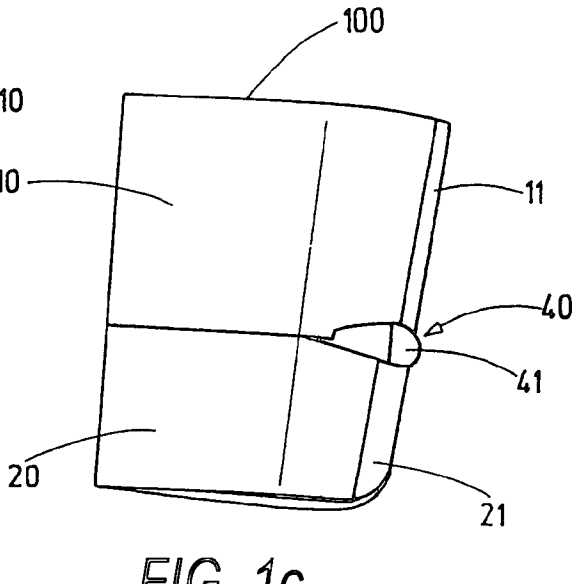
FIGS. 1*a* to 1*d* are schematic different perspective views of a first embodiment of the invention.
Figure 1B:
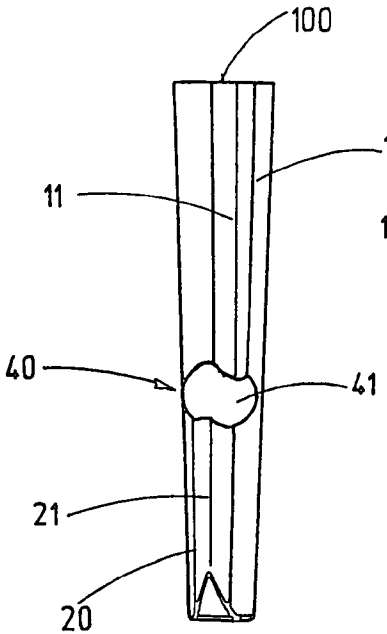
Figure 1A:
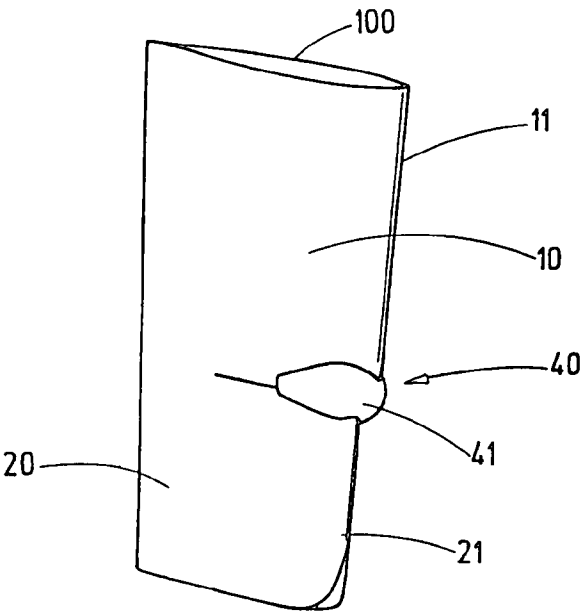
Figure 1D:
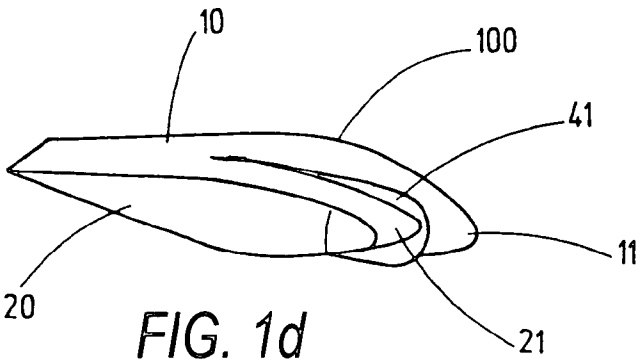
Figure 2A:
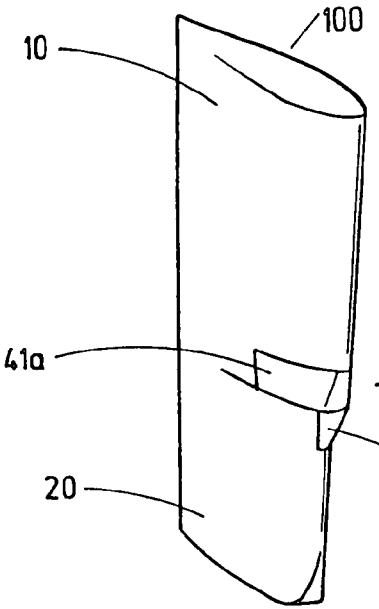
FIGS. 2*a* to 2*d* are schematic different perspective views of a second embodiment of the invention.
Figure 2B:
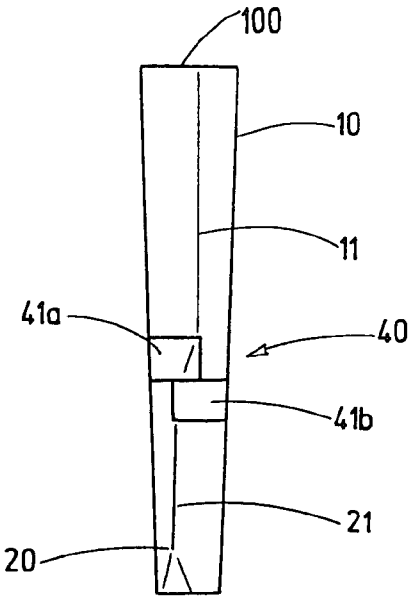
Figure 2C:
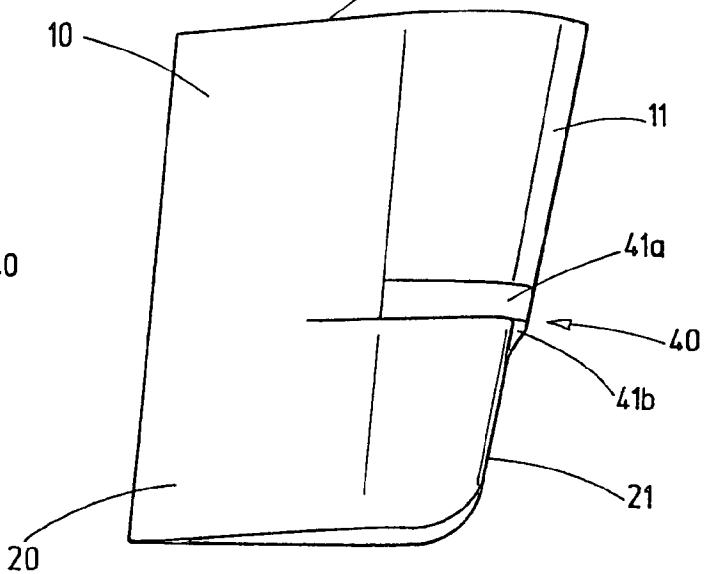
Figure 2D:
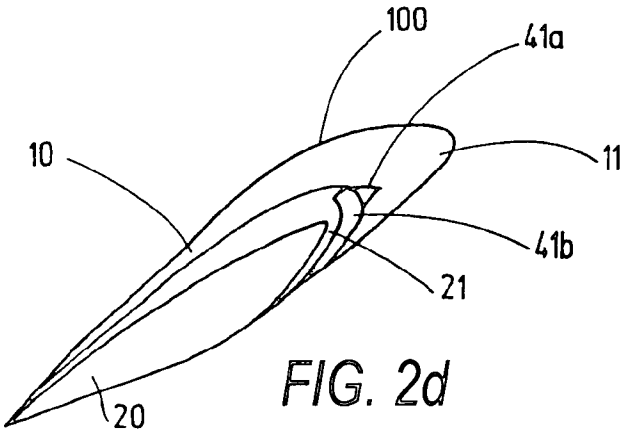

FIGS. 1*a* to 1*d* are perspective views of an embodiment of the rudder according to the invention obliquely from the front, from the front, from the side as well as from below. The FIGS. show respectively a rudder 100 which is made of an upper and of a lower rudder blade section 10, 20. The upper rudder blade section 10 has respectively an upper front leading edge 11 and the lower rudder blade section a lower front leading edge 21, wherein the leading edges 11, 21 are offset or twisted with respect to each other. In particular, this can be seen in FIG. 1*b*. This being, the upper leading edge 11 is offset to the port side and the lower leading edge 21 is offset to the starboard side. A flow body 41 is provided in the transition area 40 between the upper leading edge 11 and the lower leading edge 21. The flow body 41 is made of wrought iron and is substantially configured drop-shaped, wherein it is substantially arranged at flush level with the upper leading edge 11 with respect to the side of the rudder 10 which is turned to the propeller. The drop-shaped flow body 41 which covers the offset surfaces created by the offset of the two leading edges 11, 21 is provided on these offset surfaces. Thus, a rounded-off transition is created in the transition area 40 between the two leading edges 11, 21 and the rudder profile is closed fluidically. The gradual angular transition between the two profiles 11, 21 in the area of the offset surfaces is covered by the flow body 11 so that the offset surfaces cannot be seen in FIGS. 1*a* to 1*d*. In FIG. 1*b*, it can be furthermore recognized that the width of the flow body 41 is somewhat smaller than the maximal width of the rudder blade 100.

The flow can flow along the rounded-off transition or the flow guiding surface made available by the flow body 41 without swirls, flow breakaway or the like arising. The drop-shaped flow body 41 has a front hemispherical area which covers or encompasses both leading edges 11, 21 in their area turned to the propeller. This being, it does not project or only a little over the leading edges 11, 21. The rear part of the flow body 41 converges similarly to a truncated cone.

FIGS. 2*a* to 2*d* shows similar illustrations of a further embodiment of the invention. Contrary to the embodiment in FIGS. 1*a* to *d*, two flow bodies 41*a*, 41*b* are placed in the transition area 40, wherein each flow body is assigned respectively to an offset surface of a leading edge 11, 21. The flow bodies 41*a*, 41*b* constitute guiding surfaces which extend obliquely with respect to a vertical axis from the outer edge of a front leading edge to the other front leading edge. They are configured rounded-off in the front area turned to the propeller. The flow bodies 41*a*, 41*b* can consist for example of several layers of wrought iron which are disposed in the transition area 40 on the rudder blade 100. Due to the flow bodies 41*a*, 41*b*, the profile of the rudder blade 100 is fluidically closed.

Figure 3:
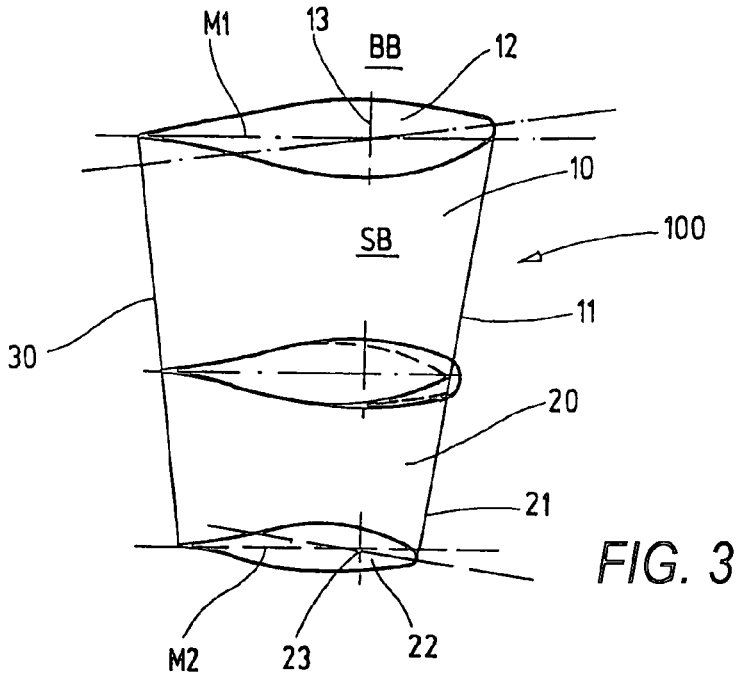
FIG. 3 is a schematic a rudder blade according to one of FIGS. 1*a* to 1*d* or to FIGS. 2*a* to 2*d* with figured cross-sectional shapes in the upper and in the lower rudder blade section.

FIG. 3 shows a further side view of a rudder according to the invention, wherein an upper, a lower as well as a central cross-sectional surface which is situated in the transition area between the two rudder blade sections 20, 21 are charted. The flow bodies 41 which are placed in the transition area between the leading edges 11, 21 are omitted in FIGS. 3, 3*a* and 3*b* for reasons of clarity. The upper leading edge 11 is offset to the port side and the other lower leading edge 21 is offset to the starboard side. Both side wall surfaces 100*a*, 100*b* of the rudder blade 100 converge in an trailing edge 30 turned away from the propeller. This being, the upper and the lower rudder blade section 10, 20 of the rudder blade 100 are configured as follows.

Figure 3A:
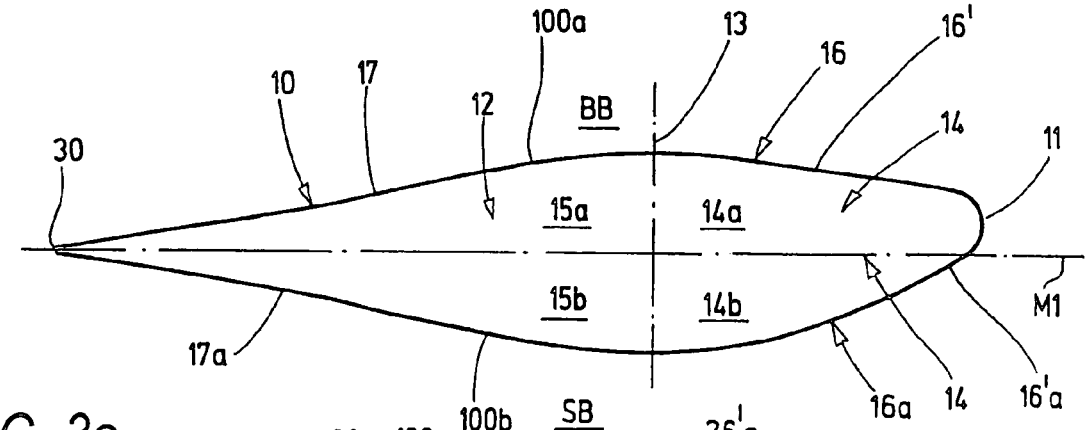
FIG. 3*a* is a schematic top view of the cross-sectional profile of the upper rudder blade section in the upper and in the lower rudder blade section.

The upper rudder blade section 10 has, according to FIG. 3*a*, a cross-sectional profile 12 which is formed by a front surface 14 conically widening from the front leading edge 11 to a biggest profile thickness 13. A rear surface 15 which extends to the trailing edge 30 and tapers to the trailing edge 30 follows this front surface 14. The front surface 14 is divided by a middle line M1 in longitudinal direction of the rudder blade 100 into two surface sections 14*a*, 14*b* which have different sizes.

This being, the bigger surface section 14*a* is situated on the port side and the smaller surface section 14*b* is turned to the starboard side. The rear surface 15 is also divided by the middle line M1 into two surface sections 15*a*, 15*b*. Both surface sections 15*a*, 15*b* have here the same size and the same shapes.

Both propeller-sided surface sections 14*a*, 14*b* of the cross-sectional profile 12 of the upper rudder blade section 10 have edge areas 16, 16*a* with a flat course 16*a*, wherein both surfaces 15*a*, 15*b* of the cross-sectional profile 12 of the upper rudder blade section 10 which are turned off the propeller 220 have tangentially extending edge areas 17, 17*a*.

The surface section 14*b* with the edge area 16*a* with a strong vaulted curved course 16*a* is situated on the starboard side. The side walls 100*a*, 100*b* in the areas of the biggest profile thickness 13, 23 have a convexly-shaped bent course on the port side as well as the starboard side.

Figure 3B:
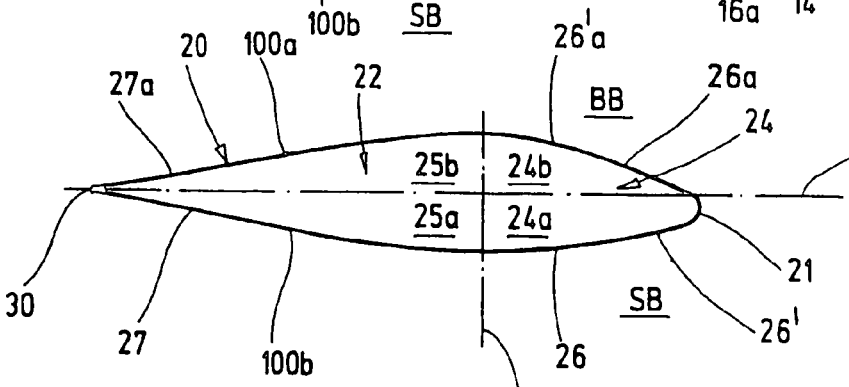
FIG. 3*b* is a schematic top view of the cross-sectional profile of the lower rudder blade section of the rudder of FIG. 3.

The lower rudder blade section 20 has, according to FIG. 3*b*, a mirror-inverted cross-sectional profile 22. This cross-sectional profile 22 extends from a surface which conically widens in the direction from the front leading edge 21 to the trailing edge 30, namely to a biggest profile thickness 23. A surface 25 which extends to the trailing edge 30 and which tapers to the trailing edge 30 follows this front surface 24. The front surface 24 is divided by a middle line M2 running in longitudinal direction of the rudder blade 100 into two surface sections 24*a*, 24*b* which have different sizes. This being, the bigger surface section 24*b* is situated on the starboard side and the smaller surface section 24*a* is turned to the port side. The rear surface 25 is also divided by the middle line M2 into two surface sections 25*a*, 25*b*. Here both surface sections 25*a*, 25*b* have the same size and the same shapes.

Both propeller-sided surface sections 24*a*, 24*b* of the cross-sectional profile 22 of the upper rudder blade section 20 have edge areas 26, 26*a* with a flat course 26' and a vaulted curved course 26'*a*, wherein both surfaces 25*a*, 25*b* of the cross-sectional profile 22 of the lower rudder blade section 20 which are turned away from the propeller 220 have tangentially running edge areas 27, 27*a*.

The surface section 24*b* with the edge area 26*a* with a strongly vaulted curved course 26'*a* is situated on the port side.

The configuration and arrangement of both rudder blade sections 10, 20 results in that the leading edge 11 assigned to the propeller 220 of the upper rudder blade section 10 is situated on the port side to the middle line M1 and the leading edge 21 of the lower rudder blade section 20 is situated on the starboard side to the middle line M2, wherein both rudder blade sections 10, 20 are joined in the rear area of the rudder blade 100 in an trailing edge 30.

According to the FIGS. 3, 3*a* and 3*b*, both rudder blade sections 10, 20 of the rudder blade 100 with their cross-sectional profiles 12, 22 are arranged in such a manner that the side wall sections of the rudder blade which are situated in the area of the strongly bent curved courses 16'*a* and 26'*a* of the surface sections 14*b* and 24*b* on the port side and on the starboard side are then turned to the surface section 14*b* of the cross-sectional profile 12 of the starboard side and to the surface section 24*b* of the cross-sectional profile 22 to the port side so that the leading edges 11, 21 of both rudder blade sections 10, 20 are situated on the port side and on the starboard side.

The rudder can also be configured in such a manner that both rudder blade sections 10, 20 of the rudder blade 100 with their cross-sectional profiles 12, 22 are placed in such a manner that the side wall sections of the rudder blade which are situated in the area of the strongly bent curved courses 16'*a* and 26'*a* of the surface sections 14*b* and 24*b* on the port side and on the starboard side, wherein the surface section 14*b* of the cross-sectional profile 12 is turned to the port side and the surface section 24*b* of the cross-sectional profile 22 to the starboard side so that the leading edges 11, 21 of both rudder blade sections 10, 20 are situated on the starboard and port side.

Figure 4:
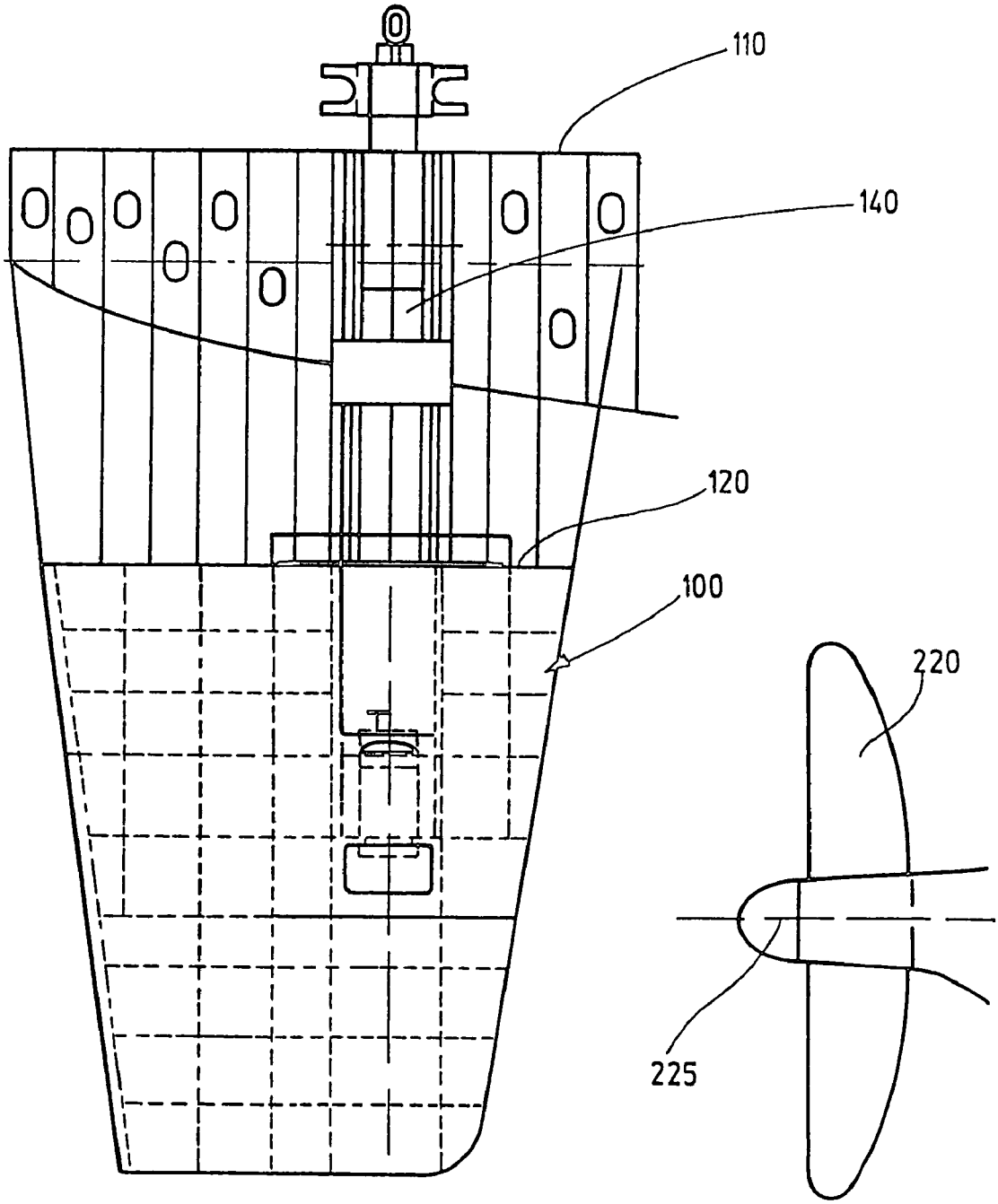
FIG. 4 shows schematically the rudder arrangement with a rudder post positioned in a rudder trunk and a fixing point of the rudder post with the rudder blade which is situated above the propeller shaft middle.

For the rudder configuration represented in FIG. 4, 110 designates a hull, 120 a rudder trunk, 100 a rudder blade and 140 a rudder post. A propeller 220 is assigned to the rudder blade 100. The rudder blade depicted in FIG. 4 is also twisted which cannot be seen in the side view. Moreover, the flow body between the offset front leading edges is omitted in the representation of FIG. 4 for reasons of clarity.

Figures 5, 6:
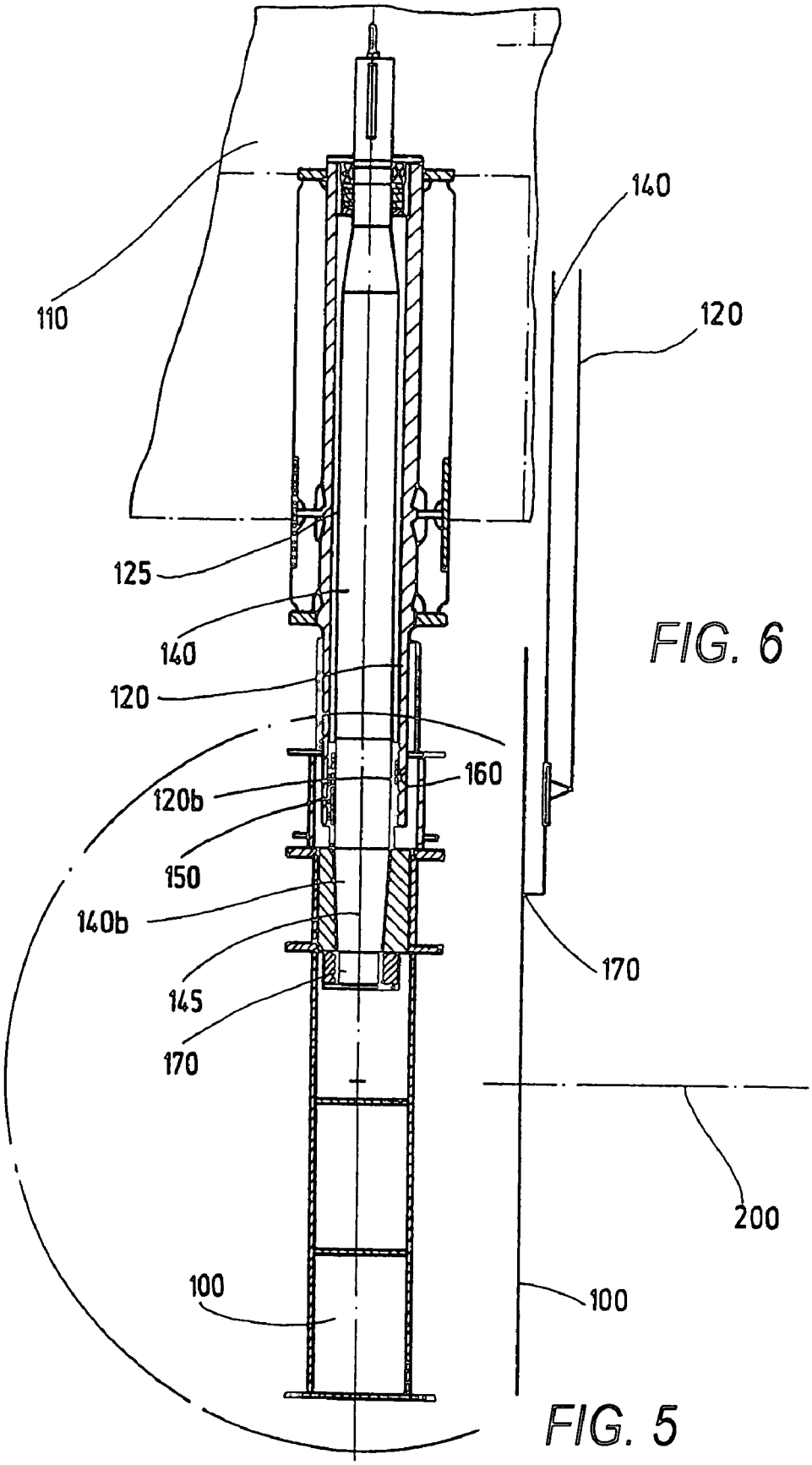
FIG. 5 is a schematic vertical sectional view through the arrangement of FIG. 4.
FIG. 6 shows a schematic representation of a bearing arrangement between the rudder post and the rudder trunk.
Figure 7:
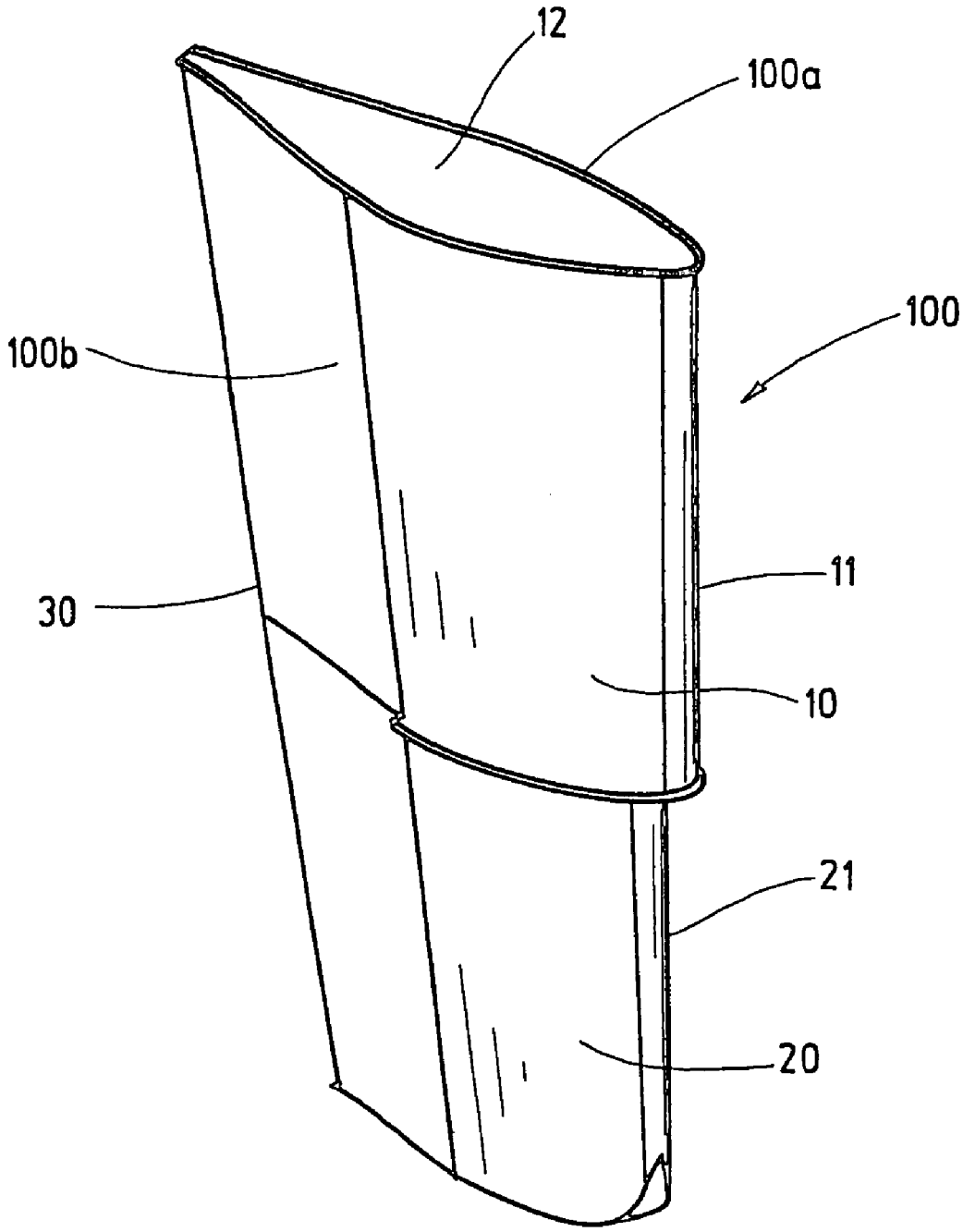
FIG. 7 PRIOR ART
FIG. 7 is a schematic perspective view of a twisted rudder of the prior art.
Figure 8:
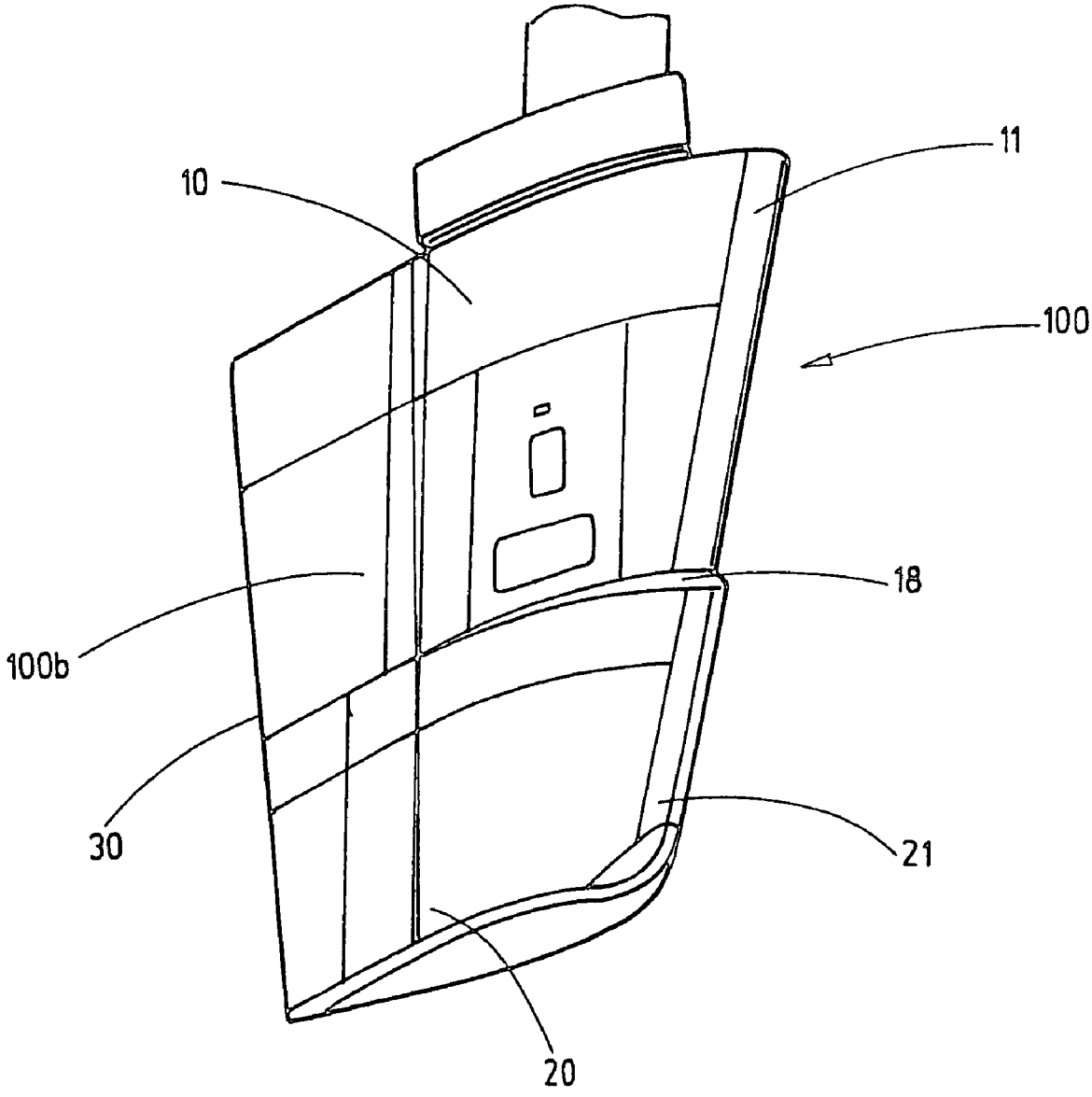
FIG. 8 PRIOR ART
FIG. 8 is a schematic perspective view of a further twisted rudder known by the prior art.
Figure 9:
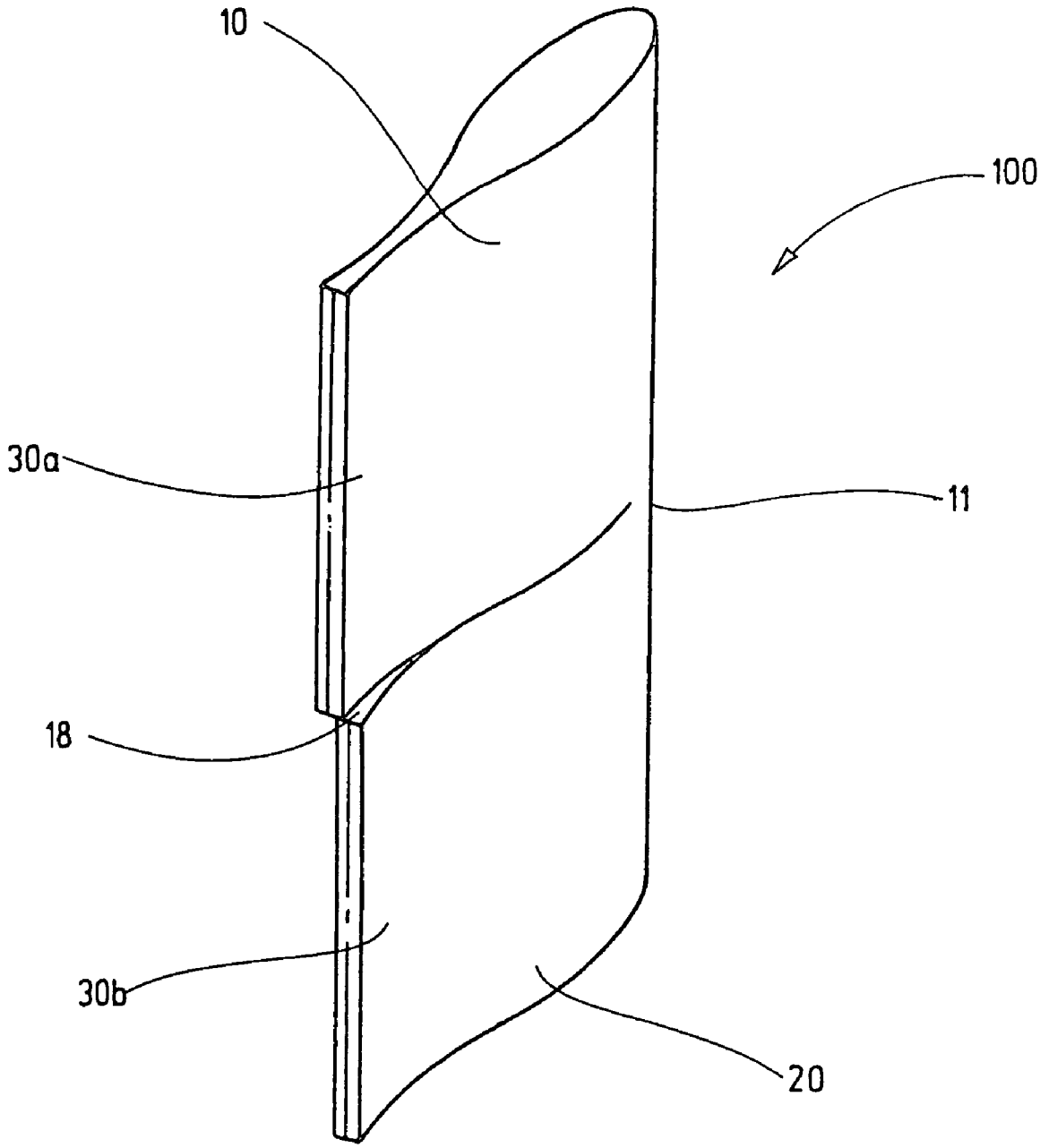
FIG. 9 PRIOR ART
FIG. 9 is a schematic perspective view of still another twisted rudder known in the prior art.

FIG. 5 shows a section through the bearing arrangement of the rudder bearing of FIG. 4 and FIG. 6 shows a schematic illustration of a bearing arrangement between the rudder post and the rudder trunk. The rudder trunk 120 is provided as a cantilever with a central inner longitudinal bore 125 for receiving the rudder post 140 for the rudder blade 100. Moreover, the rudder trunk 120 is configured protruding into the rudder blade 100 which is connected with the rudder post end. In its inner bore 125, the rudder trunk 120 has a bearing 150 for bearing the rudder post 140, wherein preferably this bearing 150 is placed in the lower end area 120*b* of the rudder trunk 120. The rudder post 140 is guided with its end 140*b* with its free section 145 out of the rudder trunk 120. This free section 145 of the rudder post 140 is fixedly connected with the rudder blade 100 by means of a press fit and a security nut 170, wherein, however, a connection is also provided which makes possible a loosening of the rudder blade 100 from the rudder post 140 when the propeller shaft has to be replaced. The connection of the rudder post 140 with the rudder blade 100 is situated above the propeller shaft middle 200 so that, for disassembling the propeller shaft, only the rudder blade 100 must be removed from the rudder post 140 while on the other hand a pulling out of the rudder post 140 out of the rudder trunk 120 is not necessary since the free lower end 120*b* of the rudder trunk 120 as well as the free lower end of the rudder post 140 are situated above the propeller shaft middle. For the embodiments shown in FIGS. 4 to 6, only a single inner bearing 150 is provided for supporting the rudder post 140 in the rudder trunk 120; a further bearing for the rudder blade 100 on the outer wall of the rudder trunk 120 is not necessary. For receiving the free lower end 120*b* of the rudder trunk 120, the rudder blade 100 is provided with a taper or recess indicated by 160.

For this rudder, the rudder trunk 120 is provided as a cantilever girder with a central inner longitudinal bore 125 for receiving the rudder post 140 for the rudder blade 100. Moreover, the rudder trunk 120 is configured penetrating into the rudder blade 100 connected with the rudder post end and has in its inner bore 125 a bearing 150 for supporting the rudder post 140 in the rudder trunk 120. With its free end 120*b*, the rudder trunk 120 is reaching into a recess or taper 160 in the rudder blade 100, wherein the rudder post 140 is guided in its end area 140*b* with a section 145 out of the rudder trunk 120. With this section 145, the rudder post 140 is connected with the rudder blade 100, wherein the connection of the rudder post 140 with the rudder blade 100 is situated above the propeller shaft middle 225. The inner bearing 150 is preferably provided in the end area 120*b* of the rudder trunk 120.

While specific embodiments of the invention have been shown and described in detail to illustrate the inventive principles, it will be understood that the invention may be embodied otherwise without departing from such principle.

We claim:

1. A rudder for ships, comprising:

a rudder blade having two superimposed rudder blade sections, the rudder blade sections each having a leading edge section, the leading edge sections being offset such that a first leading edge section is offset port or starboard and a second leading edge section is offset starboard or port, wherein the first leading edge section has a port-sided offset surface which projects over the second leading edge section, and the second leading edge section has a starboard-sided offset surface which projects over the first leading edge section;

a flow body which covers the port-sided and starboard-sided offset surfaces, the flow body being provided in an area of each of the offset surfaces;

a rudder trunk having a central inner longitudinal bore for receiving a rudder post for the rudder blade, the rudder trunk being configured to penetrate into the rudder blade end; and an inner bearing disposed in the inner longitudinal bore of the rudder trunk for supporting the rudder post, the bearing having a free end that penetrates into a recess of taper in the rudder blade;

wherein no bearing is provided between the rudder blade and the rudder trunk, and a connection of the rudder post with the rudder blade is situated above a propeller shaft axis.

2. The rudder according to claim 1, wherein the flow body forms a flow guiding surface.

3. The rudder according to claim 1, wherein the flow body forms a substantially edgeless transition between the two leading edge sections in the area of the offset surfaces.

4. The rudder according to claim 1, wherein the flow body ends flush with at least one of the leading edge sections.

5. The rudder according to claim 1, wherein a maximum projection of the flow body over the leading edge sections is 10% of a mean profile length of the rudder blade.

6. The rudder according to claim 1, wherein a maximum projection of the flow body over the leading edge sections is 7% of a mean profile length of the rudder blade.

7. The rudder according to claim 1, wherein a maximum projection of the flow body over the leading edge sections is 5% of a mean profile length of the rudder blade.

8. The rudder according to claim 1, wherein of the flow body has a length corresponding to a length of the offset surfaces.

9. The rudder according to claim 1, wherein a maximum width of the flow body equals a largest profile thickness of the rudder.

10. The rudder according to claim 1, wherein a maximum width of the flow body equals a largest profile thickness of the rudder in a transition area between the two rudder blade sections.

11. The rudder according to claim 1, wherein the flow body has a rounded shape.

12. The rudder according to claim 1, wherein one flow body has a flow guiding surface for both offset leading edge sections.

13. The rudder according to claim 12, wherein the flow body is spherical, drop-shaped or torpedo-shaped.

14. The rudder according to claim 1, wherein a flow body is provided in an area of each offset surface.

15. The rudder according to claim 14, wherein the flow body comprises an inclined plane and extends obliquely from an outer edge of the offset surface of a leading edge section.

16. The rudder according to claim 1, wherein the rudder blade has a cross-sectional surface that decreases in size from an upper area of the rudder blade to a lower area of the rudder blade.

17. The rudder according to claim 1, wherein the rudder blade includes:

an upper rudder blade section with a cross-sectional profile which is formed by a first cross-sectional surface which is facing a propeller, and extends from the first leading edge section facing the propeller in a direction of a rear trailing edge and which widens conically to a largest profile thickness, as well as by a second cross-sectional surface which follows the first cross-sectional surface and tapers conically to the rear trailing edge, wherein both cross-sectional surfaces sections of the first cross-sectional surface facing the propeller are formed by a middle line extending in a longitudinal direction of the rudder blade and have different sizes, a larger of the cross-sectional surface sections being situated on the port side, and a smaller of the cross-sectional surface sections (14*b*) being situated on the starboard side, wherein both cross-sectional surface sections of the second cross-sectional surface are formed by the middle line in an area of the cross-sectional profile facing away from the propeller, and are configured alike; and a lower rudder blade section with a cross-sectional profile which is formed by a third cross-sectional surface facing the propeller, and extending from the second leading edge facing the propeller in the direction of the rear trailing edge and widening conically to a largest profile thickness as well as by a fourth cross-sectional surface which follows the third cross-sectional surface and tapers conically to the rear trailing edge, wherein both cross-sectional surface sections of the third cross-sectional surface being formed by a middle line extending in the longitudinal direction of the rudder blade so as to have different sizes, a larger of the cross-sectional surface sections being situated on the starboard side, and a smaller of the cross-sectional surface sections being situated on the port side, wherein both cross-sectional surface sections of the fourth cross-sectional surface are formed by the idle line in an area of the cross-sectional profile facing away from the propeller and are configured alike wherein the cross-sectional surface of the upper rudder blade section is larger than the cross-sectional surface of the lower rudder blade section.

18. The rudder according to claim 1, wherein the leading edge sections facing a propeller have a rounded profile.

* * * * *